US008026203B2

(12) United States Patent
Courchay et al.

(10) Patent No.: US 8,026,203 B2
(45) Date of Patent: Sep. 27, 2011

(54) SURFACTANT CONCENTRATE

(75) Inventors: Florence Catherine Courchay, Brussels (BE); Walter Nuyts, Mechelen (BE); Johannes Georg Winter, Unterhaching (DE)

(73) Assignee: The Procter & Gamble Company, Cincinnati, OH (US)

( * ) Notice: Subject to any disclaimer, the term of this patent is extended or adjusted under 35 U.S.C. 154(b) by 135 days.

(21) Appl. No.: 12/475,741

(22) Filed: Jun. 1, 2009

(65) Prior Publication Data

US 2009/0298739 A1 Dec. 3, 2009

(51) Int. Cl.
*C11D 17/00* (2006.01)

(52) U.S. Cl. ..... 510/424; 510/426; 510/428; 510/438; 510/439

(58) Field of Classification Search ..... None
See application file for complete search history.

(56) References Cited

U.S. PATENT DOCUMENTS

| | | | |
|---|---|---|---|
| 2,220,099 | A | 11/1940 | Guenther et al. |
| 2,477,383 | A | 7/1949 | Lewis |
| 3,664,961 | A | 5/1972 | Norris |
| 3,835,163 | A | 9/1974 | Rapko |
| 3,919,678 | A | 11/1975 | Penfold |
| 3,923,679 | A | 12/1975 | Rapko |
| 4,102,903 | A | 7/1978 | Crutchfield |
| 4,120,874 | A | 10/1978 | Crutchfield |
| 4,158,635 | A | 6/1979 | Crutchfield et al. |
| 4,222,905 | A | 9/1980 | Cockrell, Jr. |
| 4,239,659 | A | 12/1980 | Murphy |
| 4,246,612 | A | 1/1981 | Berry et al. |
| 4,634,551 | A | 1/1987 | Burns et al. |
| 4,966,723 | A | 10/1990 | Hodge et al. |
| 5,114,611 | A | 5/1992 | Van Kralingen et al. |
| 5,227,084 | A | 7/1993 | Martens et al. |
| 6,660,708 | B2 | 12/2003 | Kaess |
| 6,794,347 | B2 | 9/2004 | Hsu et al. |

FOREIGN PATENT DOCUMENTS

| | | | |
|---|---|---|---|
| EP | 0 482 807 | B1 | 12/1995 |
| EP | 507 402 | B1 | 2/1999 |

*Primary Examiner* — Necholus Ogden, Jr.
(74) *Attorney, Agent, or Firm* — Ronald T. Sia; Julie A. McConihay

(57) ABSTRACT

The present relates to a surfactant concentrate comprising at least 75% of an essentially completely neutralized anionic sulphated surfactant and 5% to 25% carboxylic acid, of which 4% to 96% of the carboxylic acid is in its free acid form, the process for making it and a detergent composition containing it.

10 Claims, No Drawings

SURFACTANT CONCENTRATE

TECHNICAL FIELD

The present invention relates to the field of surfactant concentrates, processes for making them and detergent compositions containing them.

BACKGROUND TO THE INVENTION

Detergent manufacturers constantly seek to improve their product performance, process flexibility and more recently, the environmental impact or sustainability of their products. It has therefore been a desire for some time to produce and sell compact formulae that use less water and require less packaging whilst maintaining, and preferably improving, product performance.

Anionic surfactants, especially sulphated surfactants are pre-processed, prior to inclusion into a product composition, into a processable surfactant concentrate. Typically water is used to control the viscosity of the concentrate. However, this presents a problem when formulating for compact formulae as discussed above, as it is the general aim to reduce the water content of the product composition. This problem is particularly relevant when the product composition is to be sold as a unit dose of a liquid composition within a water-soluble or dispersible pouch. In this latter situation, the product is not stable when the composition comprises greater than 20% water. Hence it is the aim of the formulator, to reduce the level of water being brought into the final product through the raw materials.

Furthermore, when manufacturing sulphated surfactant concentrates it is essential that the surfactant concentrate can be processed, shipped, stored, pumped and ultimately used in its designated application throughout the life time of the concentrate. Typical issues that arise are either, a viscosity of the concentrate that is too high to process effectively or the instability of its key active, an anionic sulphated surfactant, over time. If not stabilised, the sulphated anionic surfactant either physically or chemically disintegrates into its constituent parts or other degradation products. It is essential therefore, that the concentrate firstly provides sufficient stability over time from point of making, until the point of its application. This stability must be achievable at all temperatures at which the surfactant concentrate is processed, shipped, stored, pumped and applied. Secondly, the surfactant concentrate must also have a pumpable viscosity throughout its lifetime.

EP 507 402 (Unilever) relates to a continuous process for preparing a liquid detergent composition comprising anionic surfactant and nonionic surfactant. The detergent composition has a low water content. In this process, equimolar amounts of neutralizing agent and a liquid acid precursor of the anionic surfactant are blended simultaneously in the presence of nonionic surfactant. EP 507 402 describes the presence of fatty acid, but requires that the fatty acid be present in the free acid form.

EP 1 272 605 (Unilever) relates to a continuous process for preparing a fluid detergent composition comprising anionic surfactant. Said process comprises mixing, in a first mixer, an anionic surfactant precursor with sufficient neutralization agent to achieve 25-75% neutralization of the anionic surfactant precursor, then mixing the result with sufficient further neutralization agent in a second mixer to achieve 100% neutralization. EP 1 272 605 mentions the presence of soap, meaning the salt thereof, and describes the benefits of using a salt in this context.

It is the object of the present invention to develop an anionic sulphated surfactant concentrate that does not require the use of water for process ability and an efficient, continuous process for making said concentrate. It has been a further aim of the present invention to develop a highly efficient anionic sulphated surfactant concentrate wherein the high efficiency of the surfactant means that less surfactant is required in the finished product. Such a highly efficient surfactant system permits formula flexibility, reduces the environmental impact and irritancy of the concentrate or final product composition.

SUMMARY OF THE INVENTION

According to the present invention there is provided a surfactant concentrate comprising at least 75% of an essentially completely neutralized anionic sulphated surfactant and 5% to 25% carboxylic acid, of which 4% to 96% of the carboxylic acid is in its free acid form.

According to the present invention there is also provided a process of preparing the concentrate comprising combining anionic sulphated surfactant acid precursor with sufficient neutralising agent to essentially completely neutralize said anionic surfactant, and 5% to 25% by weight of the concentrate of a carboxylic acid, of which 4% to 96% of the carboxylic acid is in its free acid form.

According to a further embodiment of the present invention, there is also provided a detergent product composition comprising the surfactant concentrate, and less than 20% water.

DETAILED DESCRIPTION OF THE INVENTION

By weight according to the present, shall means % by weight.

The concentrate preferably has pH in the range of from 5 to 7.5, more preferably the concentrate has pH from 5.5 to 7.5 and most preferably from 5.8 to 7.5. However the choice of pH will depend on the pka of the carboxylic acid used. Suitable methods to measure pH are known in the art. According to the present invention, pH measurements are carried out using a calibrated Knick type 911 pH meter. The pH measurement is carried out as follows: 5 w % of the surfactant concentrate is added to 95 w % of distilled and de-ionized water and stirred using an IKA overhead stirrer using a pitched blade for a maximum of 10 min at 800 rpm at 21° C. The pH of the resulting mixture is measured by dipping the pH electrode of the calibrated pH meter into the mixture. The pH is read after 1 min to allow for stabilization of the pH reading.

The "pumpable viscosity" as defined herein is a viscosity of no more than 10 Pas at 20 $s^{-1}$, at the temperature of pumping (20-60° C.). Fluids of higher viscosity may in principle still be pumpable at higher temperatures. An upper limit of 10 Pas at shear rate of 20 $s^{-1}$ at 60° C. is used herein to indicate easy pumpability. Surfactant concentrates which do not have viscosity below 10 Pas at of 20 $s^{-1}$ at any temperature within the range of 20-60° C. are non pumpable, according to the present invention.

Methods to measure viscosity are known in the art. According to the present invention viscosity measurements are carried out using a rotational rheometer e.g. TA instruments AR550. The instrument includes a 40 mm steel parallel plate, using a gap of 500 μm. The measurement is carried out using a flow procedure that contains a conditioning step and a continuous ramp step. The conditioning step involves the setting of a measurement temperature and an equilibration of minimum 10 seconds at the selected temperature within a range of 20-60° C. The continuous ramp step is performed at a shear rate from 0.04 to 50 $s^{-1}$ to obtain the full flow profile. Unless stated otherwise viscosity data quoted herein refers to the viscosity reading at 20 $s^{-1}$.

Anionic Sulphated Surfactant

The concentrate according to the present invention comprises a sulphated anionic surfactant. More preferably the sulphated surfactant is selected from linear or branched, C10 to 22 alkyl sulphate or C10 to 22 alkyl alkoxy sulphate surfactants. Most preferably the sulphated anionic surfactant is from natural feed stocks. Natural feedstock surfactants are preferred for performance an supply availability reasons.

In a preferred embodiment of the present invention, the anionic surfactant is an alkyl alkoxy sulphate. More preferably the surfactant is an alkyl ethoxy sulphate. Most preferably alkyl polyethoxylate sulfates in which the alkyl group contains from 10 to 22, preferably from 12 to 18 carbon atoms and wherein the polyethoxylate chain contains from 1 to 15, more preferably from 1 to 6 ethoxylate moieties. Alkyl ethoxy sulphate (AES) is particularly preferred because of its whiteness cleaning performance and high efficiency. Such benefits bring the advantage that the composition requires less surfactant to achieve the same benefit as compared to the more traditional alkyl benzene sulphonate/nonionic surfactant system. Hence either whiteness performance benefit can be improved or the formula can be compacted, without any loss in performance. AES is further preferred since the efficiency is such that equal performance can even be achieved in cold water wash conditions. Whilst this has no effect on the concentrate per se, it does mean that the user of the detergent composition can select a lower wash temperature, thereby saving energy.

The anionic sulphated surfactant in the concentrate is essentially completely neutralized. That is to say that the anionic surfactant is 98% to 100% neutralized. Surfactant which is less than 98% neutralized is not stable. The neutralising agent can, in principle, be any suitable alkaline substance. The neutralising agent can be selected from the group consisting of alkaline, alkaline earth metal or substituted ammonium hydroxide, carbonate, bicarbonate, silicate or mixtures thereof. Alternatively the neutralising agent may be an amine or amide. More preferably the neutralising agent is an alkanolamine selected from monoethanolamine, diethanolamine, triethanolamine, 2-aminopropanol, monoisopropanol amine (MIPA) or mixtures thereof. Most preferably the neutralising agent is monoethanolamine (MEA).

The sulphated anionic surfactant is present in the concentrate at a level of at least 75%, more preferably 80%, most preferably 85% by weight of the concentrate.

Sulphated anionic surfactants however are notoriously difficult to process as at high concentration they also bring high viscosity. The higher the viscosity, the more difficult the surfactant is to process. According to the present invention, carboxylic acid is innovatively used as a solvent to manage the viscosity of the anionic surfactant concentrate. However the Applicants have also found that alkyl (alkoxy) sulphates are not stable in acidic conditions, tending to revert over time to the constituent elements. This is the reason why surfactants that are less than 98% neutralized are not stable. The reversion reaction is further accelerated by acidic conditions. Hence the reaction is self-catalytic, in that one of the reversion products, sulphuric acid, further stimulates the reversion reaction, resulting in faster reversion of the surfactant. The presence of carboxylic acid, according to the invention, stabilizes the anionic surfactant. It is believed that the fatty acid anion reacts with the free hydrogen atom, producing fatty acid, and leaving the salt ion to stabilize the anionic surfactant as the carboxylic acid anion functions as a proton sink.

Carboxylic Acid

The present concentrate comprises a carboxylic acid. The carboxylic acid is present in the concentrate at a level of from 5% to 25% by weight of the concentrate. More preferably the carboxylic acid is present at a level of from 10% to 25%, even more preferably from 17% to 23% by weight of the concentrate. It is essential in the present invention that from 4% to 96% of the total carboxylic acid is present in its free acid form. Thus 96% to 4% of the total carboxylic acid is present in its anionic carboxylic acid form or soap. For the best conditions favoring stability of the anionic surfactant, it is preferred that from 40% to 60% of the carboxylic acid is present in its free fatty acid form. However for the best overall conditions providing both sufficient stability and sufficient solvency, it is preferred that from 60% to 90%, more preferably 75% to 90% of the carboxylic acid is present in its free acid form. Most preferably 80% to 87% of the carboxylic acid is present in its free acid form, and thus 13% to 20% of the carboxylic acid is present in the soap form.

It is essential that said ratio of free acid to soap form of the carboxylic acid is adhered to, as the carboxylic acid performs two separate functions. When in the acid form, the carboxylic acid performs as a solvent. The overall effect of the solvent is to lower the viscosity of the concentrate. The impact of the free acid on the concentrate viscosity can be seen in table 1. With decreasing pH more fatty acid is present as free fatty acid increasing the level of solvent and thus lowering the viscosity of the surfactant concentrate. It is thus an essential element of the present invention that a significant percentage of the fatty acid is present as free fatty acid in the surfactant concentrate.

TABLE 1

Viscosity of surfactant concentrates consisting of 78% MEA/C12-14 alkyl ethoxy sulphate with 3 moles of ethoxylation, 20% DTPK Fatty acid, and 2% MEA and minors vs. pH and temperature.

| | Concentrate pH | | | | | | |
|---|---|---|---|---|---|---|---|
| | 4.6 | 5.2 | 5.9 | 6.1 | 7.0 | 7.2 | 7.6 |
| 20° C. | 13.82 | 13.50 | 14.14 | 14.22 | 13.80 | 15.09 | 20.81 |
| 40° C. | **2.21*** | **6.10*** | **6.79*** | **6.71*** | **7.04*** | **7.87*** | 11.04 |
| 60° C. | **0.44*** | **0.47*** | **0.49*** | **0.48*** | **1.70*** | **3.99*** | **6.44*** |

Viscosity in Pas is measured at 20 $s^{-1}$ at the quoted temperature. Samples that meet the viscosity criteria as defined herein are highlighted with an asterix. The table contains no information on the stability of the shown surfactant concentrates.

The percentage of free fatty acid and the percentage of fatty acid anion (soap) can be obtained by calculation using the equation known in the art as the Henderson-Hasselbalch buffer equation:

$$pH=pKa+\log_{10}([\text{fatty acid anion}]/[\text{free fatty acid}])$$

Standard pKa values may be taken e.g. from U.S. Pat. No. 6,794,347 B2 or elsewhere in the art. This way the pH of the surfactant concentrate also defines, at a given Fatty acid pKa, the ratio of free fatty acid to fatty acid anion present in the surfactant concentrate and vice versa. Unless stated otherwise, in this application for simplicity reasons, we refer to the percentage of free fatty acid, knowing that the pH and the percentage of the fatty acid anion can be calculated from the Henderson-Hasselbalch equation.

When in the anionic form, the carboxylic acid performs as a proton sink, stabilizing the surfactant. The overall effect of the fatty acid anion is to react the surfactant acid precursor back to the anionic surfactant.

Methods to measure anionic surfactant activity are known in the art. According to the present invention, the anionic surfactant activity is measured using the ISO 2271-1989 and ISO 2870-1986 procedures. According to these procedures the total anionic surfactant content is determined using a two-phase titration principle. The sample containing the anionic surfactant(s) and a mixed indicator (consists of cationic and anionic dyes) are mixed in a water chloroform system. The complex between the anionic surfactant(s) and the cationic dye is red and soluble chloroform. Upon titration with Hyamine 1622 (a quarternary cationic), the red dye-surfactant complex is broken and replaced by a colorless anionic surfactant-cationic titrant complex. A colour change from red to grey in the chloroform layer indicates the end point. If excess Hyamine is added, it complexes with the anionic dye, giving a blue colour to the chloroform layer. To assess the anionic surfactant stability the anionic surfactant activity is measured fresh, immediately after making the surfactant concentrate and at a later stage, with a sample stored for a maximum of 4 weeks at a given temperature within a temperature range of 20-60° C. The activity loss is calculated by subtracting the later activity value from the fresh activity value. For convenience, the fresh value can be assumed to be 100%, so that any activity loss can be expressed in percentage activity loss. "Sufficient stability" as defined herein refers to the stability of the anionic surfactant over a period of 4 weeks at a temperature range of 20-60° C. A surfactant concentrate is rated stable if the anionic surfactant activity measurement shows less than 2% activity loss. Said 2% activity loss covers the standard deviation of the activity measurement.

As shown in table 2 the presence of fatty acid anion stabilizes the anionic surfactant as there is generally less activity loss on increasing pH. It is thus an essential element of the present invention that a sufficient percentage of the fatty acid is present as fatty acid anion, or soap, in the surfactant concentrate.

TABLE 2

Activity loss in % after 4 weeks storage of surfactant concentrate. Surfactant concentrate consisting of 78% MEA/C12-14 alkyl ethoxy sulphate with 3 moles of ethoxylation, 20% DTPK Fatty acid, and 2% MEA and minors vs. pH and temperature.

| | Concentrate pH | | | | | | |
|---|---|---|---|---|---|---|---|
| | 4.6 | 5.2 | 5.9 | 6.1 | 7.0 | 7.2 | 7.6 |
| 20° C. | 2.1% | **1.4%*** | **1.1%*** | **1.4%*** | **1.6%*** | **1.4%*** | **1.4%*** |
| 40° C. | 3.3% | 2.6% | **1.6%*** | **1.9%*** | **1.0%*** | **0.9%*** | **1.3%*** |
| 60° C. | 99.8% | 99.7% | 9.4% | **4.1%*** | **0.9%*** | **1.6%*** | **0.9%*** |

Samples that meet the stability criteria of being less than 2% as defined herein are highlighted with an asterix. The table contains no information on the viscosity of the shown surfactant concentrates.

Failure to meet either the percentage criteria of free fatty acid or the percentage criteria of fatty acid anion results in either non-pumpable or non-stable anionic surfactant concentrates. This is shown in table 3 which combines tables 1 and 2.

TABLE 3

Overall rating of surfactant concentrates consisting of 78% MEA/C12-14 alkyl ethoxy sulphate with 3 moles of ethoxylation, 20% DTPK Fatty acid, and 2% MEA and minors, stored for 4 weeks vs. pH and temperature. Ok means the sample meets both, the viscosity and the stability criteria. Nok means that the sample fails on at least one of the two criteria.

| | Concentrate pH | | | | | | |
|---|---|---|---|---|---|---|---|
| | 4.6 | 5.2 | 5.9 | 6.1 | 7.0 | 7.2 | 7.6 |
| 20° C. | nok | nok | nok | nok | nok | Nok | nok |
| 40° C. | nok | nok | **ok** | **ok** | **ok** | **Ok** | nok |
| 60° C. | nok | nok | nok | **ok** | **ok** | **Ok** | **ok** |

The carboxylic acid is preferably a saturated or unsaturated linear aliphatic carboxylic acid containing up to 30 carbon atoms. Mono, di, tri or polycarboxylic acids are suitable for use herein. More preferably the carboxylic acid is a fatty acid. Fatty acids are carboxylic acids generally sourced from natural sources, containing longer alkyl chains. The preferred carboxylic acids of the present invention are fatty acids having from 8 to 28 carbon atoms, more preferably from 12 to 26 carbon atoms and most preferably from 12 to 22 carbon atoms. Preferred fatty acids herein include in particular caprylic acid, perlargonic acid, capric acid, undecanoic acid, lauric acid, tridecanoic acid, myritic acid, petadecanoic acid, palmitic acid, margaric acid, stearic acid, nonadecanoic acid, arachic acid, behenic acid saturated fatty acids. Palmitoelic acid, oleic acid, erucic acid, linoleic acid, linolenic acid unsaturated acids. Preferred carboxylic acids are oleioc acid and palmitic acid, stearic acid, linoleic acid and mixtures thereof. Carboxylic acids are normally commercially available as a mixture of carboxylic acids. In this context preferred carboxylic acids are mixtures of those listed above. One preferred carboxylic acid mixture is the product known as Distilled Top Palm Kernel (DTPK) which comprises carboxylic acids with a distribution of carbon chain lengths from C12 to C18, with the following distribution 50% C12, 17% C14, 9% C16 and 2.5% C18, 17% C18', 2.5% C18" (remaining 2% made up of minor fractions 0.1% C8 and below, 1.5% C10, 0.4%>C18). Another preferred carboxylic is that commonly known as rapeseed, which comprises carboxylic acids with distribution of carbon chain lengths from C12 to C20 with the following distribution 0.5% C14, 8% C16, 2% C16', 3% C18, 54% C18', 21% C18", 10% C18'" and 6% C20. To note a (') after the chain length indicates a double bond, hence some of the fatty acids are unsaturated.

Examples 1 to 3

Examples 1 to 3 show pumpable and stable surfactant concentrates demonstrating the high value of the present invention are:

Example 1

A surfactant concentrate comprising of 78 w % MEA/AE3S, 20 w % added DTPK Fatty acid and 2% minors and alkanolamine, at a pH of 7.0 shows a viscosity of 6.7 Pas at 40° C. and an anionic surfactant activity of 99% after 4 weeks at 60° C. This concentrate thus meets the viscosity and stability criteria of the present invention. The ratio of free DTPK Fatty acid to DTPK fatty acid anion is 66.56% to 33.44%.

Example 2

A surfactant concentrate consisting of 78 w % MEA/AE3S, 20 w % added DTPK Fatty acid and 2% minors and alkanolamine, at a pH of 7.6 shows a viscosity of 6.4 Pas at 60° C. and an anionic surfactant activity of 99% after 4 weeks at 60° C. and thus meets the viscosity and stability criteria. The ratio of free DTPK Fatty acid to DTPK fatty acid anion is 33.44% and 66.56%.

Example 3

A surfactant concentrate consisting of 78 w % MEA/AE3S, 20 w % added DTPK Fatty acid and 2% minors and alkanolamine, at a pH of 5.9 shows a viscosity of 6.8 Pas at 40° C. and an anionic surfactant activity of 98% after 4 weeks at 40° C. and thus meets the viscosity and stability criteria. The ratio of free DTPK Fatty acid to DTPK fatty acid anion is 96% and 4%.

To note: The pKa of DTPK Fatty acid used to calculate the ratio of free DTPK fatty acid to DTPK fatty acid anion is 7.3.

Examples 4 to 6

Examples 4 to 6 show concentrates that are non-pumpable and/or non-stable and thus do not meet the requirements of the present invention.

Example 4

A surfactant concentrate consisting of 78 w % MEA/AE3S and 20 w % added DTPK Fatty acid and 2% alkanolamine and minors, at a pH of 4.7 fails on the stability success criteria as after 2 weeks of storage at 60° C., surfactant activity is only 66%, an activity loss of 34%. The ratio of DTPK Fatty acid to DTPK fatty acid anion is 99.74% and 0.26%. The reason for the failure is believed to be that the level of fatty acid anion is not sufficient to stabilize the anionic surfactant.

Example 5

A surfactant concentrate consisting of 78 w % MEA/AE3S and 20 w % added DTPK Fatty acid and 2% alkanolamine and minors, at a pH of 5.2 fails on the stability success criteria as after 2 weeks of storage at 60° C. surfactant activity is only 83%, an activity loss of 17%. The ratio of free DTPK Fatty acid to DTPK fatty acid anion is 99.21% to 0.76%. The reason for the failure is believed to be that the level of fatty acid anion is not sufficient to stabilize the anionic surfactant.

Example 6

A surfactant concentrate consisting of 82 w % MEA/AE3S and 10 w % added DTPK Fatty acid and 2% alkanolamine and minors, at a pH of 9.0 shows a viscosity of 26.4 Pas at 20 $s^{-1}$ and thus fails on the pumpable viscosity success criteria. The ratio of free DTPK Fatty acid to DTPK fatty acid anion is 1.96% to 98.04%. The reason for the failure is believed to be that the level of free fatty acid is not sufficient to lower the viscosity of the anionic surfactant concentrate low enough to meet the pumpable viscosity criteria.

Example 7

Example 7 is an example of a non-pumpable and non-stable surfactant concentrate without carboxylic acid. To minimize complexity it would be desired to use the simplest possible compositions of a surfactant concentrate, e.g. an amine neutralized surfactant sulphate with no solvent or proton sink other than the amine. However these simpler and purer mixtures not only fail on the viscosity criteria but also on the stability criteria. A surfactant concentrate comprising 90 w % MEA/AE3S and 10% minors and alkanolamine, at a pH of 9.8 shows a viscosity of 13.3 Pas at 60° C. at 20 $s^{-1}$ and an anionic surfactant activity of 89% after 4 weeks at 60° C. and thus fails on both the viscosity and the stability criteria.

Moisture

The concentrate preferably comprises low levels of water. In a preferred embodiment, the concentrate comprises no more than 10% water by weight of the concentrate.

Nonionic Surfactant

The concentrate of the present invention may comprise nonionic surfactant. Nonionic surfactant can be included to provide a solvent role in the lowering of the viscosity of the concentrate. Hence some carboxylic acid, in its free acid form, may be replaced by nonionic surfactant. However it is essential that the ratio of free acid to soap remains within the range required by the present invention.

Preferred nonionic surfactants include ethoxylated and propoxylated nonionic surfactants. Preferred alkoxylated surfactants can be selected from the classes of the nonionic condensates of alkyl phenols, nonionic ethoxylated alcohols, nonionic ethoxylated/propoxylated fatty alcohols.

Highly preferred are nonionic alkoxylated alcohol surfactants, being the condensation products of aliphatic alcohols with from 1 to 75 moles of alkylene oxide, in particular about 50 or from 1 to 15 moles, preferably to 11 moles, particularly ethylene oxide and/or propylene oxide, are highly preferred nonionic surfactants. The alkyl chain of the aliphatic alcohol can either be straight or branched, primary or secondary, and generally contains from 6 to 22 carbon atoms. Particularly preferred are the condensation products of alcohols having an alkyl group containing from 8 to 20 carbon atoms with from 2 to 9 moles and in particular 3 or 5 moles, of ethylene oxide per mole of alcohol.

Polyhydroxy fatty acid amides are highly preferred nonionic surfactant comprised by the composition, in particular those having the structural formula $R^2CONR^1Z$ wherein: R1 is H, $C_{1-18}$, preferably $C_1$-$C_4$ hydrocarbyl, 2-hydroxy ethyl, 2-hydroxy propyl, ethoxy, propoxy, or a mixture thereof, preferable C1-C4 alkyl, more preferably $C_1$ or $C_2$ alkyl, most preferably $C_1$ alkyl (i.e., methyl); and $R_2$ is a $C_5$-$C_{31}$ hydrocarbyl, preferably straight-chain $C_5$-$C_{19}$ or $C_7$-$C_{19}$ alkyl or alkenyl, more preferably straight-chain $C_9$-$C_{17}$ alkyl or alkenyl, most preferably straight-chain $C_{11}$-$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl.

Where present, the nonionic surfactant is preferably present at a level of up to 20% by weight of the concentrate.

Process for the Production of the Surfactant Concentrate

The concentrate of the present invention is produced by combining sulphated anionic surfactant acid precursor, neutralising agent and carboxylic acid. The concentrate of the present invention may be made in either batch or continuous processes. When using the batch process the 3 ingredients may be combined in any order. However for efficiency it is preferred that the surfactant precursor and carboxylic acid are combined in a first step, then sufficient neutralising agent is added to essentially completely neutralize the surfactant and sufficient carboxylic acid to achieve the ratio to carboxylic acid salt, required by the present invention.

The concentrate may also be made in a continuous loop process, wherein all three ingredients are combined into the loop. Small amounts of surfactant/neutralising agent/carboxylic acid product is then removed and the remainder continues in the loop reactor with a recirculation ratio of 1:10 min. Said product can then be directly used in the process to make the detergent product.

Detergent Product Composition

A further embodiment of the present invention relates to a detergent product composition comprising the surfactant concentrate described above. The composition may be in any form; liquid or solid and anything in between. Hence the composition may be loose powder, densified powder, tablet, liquid, gel or paste. Preferably the composition is in liquid form. More preferably the composition is liquid and comprises low levels of water, namely less than 35% water, more preferably 30% or less, more preferably less than 20%, even more preferably less than 15% water. In an alternative preferred embodiment, said low water-containing composition is encapsulated in a water-soluble or water-dispersible pouch.

The surfactant concentrate may be combined with the remaining detergent composition ingredients at any point in the manufacture of said detergent composition. However it is preferred that it is added at an appropriate point so as not to greatly affect the viscosity of the product. In a further preferred aspect of the process of making the detergent composition, the composition is neutralized to an appropriate pH. The pH of a 10% solution of the detergent composition in distilled water at ambient temperature is preferably in the range 7 to 9, more preferably 7.5 to 8.5, most preferably from 7.7 to 8.3. The pH of the composition is measured using standard techniques and equipment (such as that discussed before).

Optional Ingredients of the Detergent Product Composition

The detergent product composition may comprise any of the listed detergent ingredients.

Surfactants

The detergent product compositions of the present invention comprise the surfactant concentrate described above, but may additionally comprise further surfactants. Preferably the composition comprises from about 1% to 80% by weight of a surfactant. Preferably such compositions comprise from about 5% to 50% by weight of surfactant.

Further surfactants utilized can be selected from anionic, nonionic, zwitterionic, ampholytic or cationic surfactants and mixtures thereof. Detergent surfactants useful herein are described in U.S. Pat. No. 3,664,961, Norris, issued May 23, 1972, U.S. Pat. No. 3,919,678, Laughlin et al., issued Dec. 30, 1975, U.S. Pat. No. 4,222,905, Cockrell, issued Sep. 16, 1980, and in U.S. Pat. No. 4,239,659, Murphy, issued Dec. 16, 1980. Anionic and nonionic surfactants are preferred.

In a preferred embodiment, the composition of the present invention further comprises an anionic sulphonate surfactant. More preferably a sodium, potassium, substituted ammonium or alkanolamine alkylbenzene sulfonate in which the alkyl group contains from about 9 to about 15 carbon atoms, in straight chain or branched chain configuration. Such preferred surfactants are described in U.S. Pat. Nos. 2,220,099 and 2,477,383. Especially valuable for inclusion herein are linear straight chain alkylbenzene sulfonates in which the average number of carbon atoms in the alkyl group is from about 11 to 13, abbreviated to $C_{11}$-$C_{13}$ LAS.

Preferred nonionic surfactants are those of the formula $R^1(OC_2H_4)_nOH$, wherein $R^1$ is a $C_{10}$-$C_{16}$ alkyl group or a $C_8$-$C_{12}$ alkyl phenyl group, and n is from 3 to about 80. Particularly preferred are condensation products of $C_{12}$-$C_{15}$ alcohols with from about 5 to about 20 moles of ethylene oxide per mole of alcohol, e.g., $C_{12}$-$C_{14}$ alcohol condensed with about 7 moles of ethylene oxide per mole of alcohol.

Whitening Agent

The compositions of the present invention may comprise a whitening agent. The whitening agent preferably exhibits a hueing efficiency. Such dyes have been found to exhibit good tinting efficiency during a laundry wash cycle without exhibiting excessive undesirable build up during laundering.

Fabric Care Benefit Agents

The compositions may comprise a fabric care benefit agent. As used herein, "fabric care benefit agent" refers to any material that can provide fabric care benefits such as fabric softening, color protection, pill/fuzz reduction, anti-abrasion, anti-wrinkle, and the like to garments and fabrics, particularly on cotton and cotton-rich garments and fabrics, when an adequate amount of the material is present on the garment/fabric. Non-limiting examples of fabric care benefit agents include cationic surfactants, silicones, polyolefin waxes, latexes, oily sugar derivatives, cationic polysaccharides, polyurethanes, fatty acids and mixtures thereof. Fabric care benefit agents when present in the composition, are suitably at levels of up to about 30% by weight of the composition, more typically from about 1% to about 20%, preferably from about 2% to about 10%.

Detersive Enzymes

Suitable detersive enzymes for use herein include protease, amylase, lipase, cellulase, carbohydrase including mannanase and endoglucanase, and mixtures thereof. Enzymes can be used at their art-taught levels, for example at levels recommended by suppliers such as Novo and Genencor. Typical levels in the compositions are from about 0.0001% to about 5%. When enzymes are present, they can be used at very low levels, e.g., from about 0.001% or lower, in certain embodiments of the invention; or they can be used in heavier-duty laundry detergent formulations in accordance with the invention at higher levels, e.g., about 0.1% and higher. In accordance with a preference of some consumers for "non-biological" detergents, the present invention includes both enzyme-containing and enzyme-free embodiments.

Deposition Aid

As used herein, "deposition aid" refers to any cationic polymer or combination of cationic polymers that significantly enhance the deposition of a fabric care benefit agent onto the fabric during laundering.

Preferably, the deposition aid is a cationic or amphoteric polymer. The amphoteric polymers of the present invention will also have a net cationic charge, i.e.; the total cationic charges on these polymers will exceed the total anionic charge. Nonlimiting examples of deposition enhancing agents are cationic polysaccharides, chitosan and its derivatives and cationic synthetic polymers. Preferred cationic polysaccharides include cationic cellulose derivatives, cationic guar gum derivatives, chitosan and derivatives and cationic starches.

Rheology Modifier

In a preferred embodiment of the present invention, the composition comprises a rheology modifier. The rheology modifier is selected from the group consisting of non-polymeric crystalline, hydroxy-functional materials, polymeric rheology modifiers which impart shear thinning characteristics to the aqueous liquid matrix of the composition. Crystalline, hydroxy-functional materials are rheology modifiers which form thread-like structuring systems throughout the matrix of the composition upon in situ crystallization in the matrix. Specific examples of preferred crystalline, hydroxyl-containing rheology modifiers include castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis). Polymeric rheology modifiers are preferably selected from polyacrylates, polymeric gums, other non-gum polysaccharides, and combinations of these polymeric materials. Preferred polymeric gum materials include pectine, alginate, arabinogalactan (gum Arabic), carrageenan, gellan gum, xanthan gum, guar gum and mixtures thereof.

Builder

The compositions of the present invention may optionally comprise a builder. Suitable builders include polycarboxylate builders include cyclic compounds, particularly alicyclic compounds, such as those described in U.S. Pat. Nos. 3,923,679; 3,835,163; 4,158,635; 4,120,874 and 4,102,903. Particularly preferred are citrate builders, e.g., citric acid and soluble salts thereof.

Other preferred builders include ethylene diamine disuccinic acid and salts thereof (ethylene diamine disuccinates, EDDS), ethylene diamine tetraacetic acid and salts thereof (ethylene diamine tetraacetates, EDTA), and diethylene triamine penta acetic acid and salts thereof (diethylene triamine penta acetates, DTPA), hydroxy ethylene diphosphonate (HEDP), aluminosilicates such as zeolite A, B or MAP; fatty acids or salts, preferably sodium salts, thereof, preferably C12-C18 saturated and/or unsaturated fatty acids; and alkali or alkali earth metal carbonates preferably sodium carbonate.

Bleaching System

Bleaching agents suitable herein include chlorine and oxygen bleaches, especially inorganic perhydrate salts such as sodium perborate mono- and tetrahydrates and sodium percarbonate optionally coated to provide controlled rate of release (see, for example, GB-A-1466799 on sulfate/carbonate coatings), preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Peroxyacid bleach precursors preferred for use herein include precursors of perbenzoic acid and substituted perbenzoic acid; cationic peroxyacid precursors; peracetic acid precursors such as TAED, sodium acetoxybenzene sulfonate and pentaacetylglucose; pernonanoic acid precursors such as sodium 3,5,5-trimethylhexanoyloxybenzene sulfonate (iso-NOBS) and sodium nonanoyloxybenzene sulfonate (NOBS); amide substituted alkyl peroxyacid precursors (EP-A-0170386); and benzoxazin peroxyacid precursors (EP-A-0332294 and EP-A-0482807). Bleach precursors are typically incorporated at levels in the range from about 0.5% to about 25%, preferably from about 1% to about 10% by weight of composition while the preformed organic peroxyacids themselves are typically incorporated at levels in the range from 0.5% to 25% by weight, more preferably from 1% to 10% by weight of composition. Bleach catalysts preferred for use herein include the manganese triazacyclononane and related complexes (U.S. Pat. No. 4,246,612, U.S. Pat. No. 5,227,084); Co, Cu, Mn and Fe bispyridylamine and related complexes (U.S. Pat. No. 5,114,611); and pentamine acetate cobalt(III) and related complexes (U.S. Pat. No. 4,810,410).

Perfume

Perfumes are preferably incorporated into the detergent compositions of the present invention. The perfumes may be prepared as a premix liquid, may be linked with a carrier material, such as cyclodextrin or may be encapsulated.

Solvent System

The composition of the present invention preferably comprises a solvent system containing water alone or more preferably a mixture of organic solvent and water. Preferred organic solvents include 1,2-propanediol, ethanol, glycerol, dipropylene glycol, methyl propane diol and mixtures thereof. Other lower alcohols, $C_1$-$C_4$ alkanolamines such as monoethanolamine and triethanolamine, can also be used. Solvent systems can be absent, for example from anhydrous solid embodiments of the invention, but more typically are present at levels in the range of from about 0.1% to about 98%, preferably at least about 1% to about 50%, more usually from about 5% to about 25%.

Pearlescent Agent

The compositions of the present invention may comprise a pearlescent agent. Said pearlescent agent may be organic or inorganic, but is preferably inorganic. Most preferably the pearlescent agent is selected from mica, TiO2 coated mica, bismuth oxychloride or mixtures thereof.

Other Adjuncts

Examples of other suitable cleaning adjunct materials include, but are not limited to, alkoxylated benzoic acids or salts thereof such as trimethoxy benzoic acid or a salt thereof (TMBA); enzyme stabilizing systems; scavenging agents including fixing agents for anionic dyes, complexing agents for anionic surfactants, and mixtures thereof; optical brighteners or fluorescers; soil release polymers; soil suspending polymers; dispersants; suds suppressors; dyes; colorants; hydrotropes such as toluenesulfonates, cumenesulfonates and naphthalenesulfonates; color speckles; colored beads, spheres or extrudates; clay softening agents and mixtures thereof.

Water-Soluble or Dispersible Pouch

Where the composition is encapsulated within a pouch, said pouch is preferably made of a film material which is soluble or dispersible in water. More preferably the film has a water-solubility of at least 50%, preferably at least 75% or even at least 95%, as measured by the method set out here after using a glass-filter with a maximum pore size of 20 microns:

50 grams±0.1 gram of pouch material is added in a preweighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the % solubility or dispersability can be calculated.

Preferred pouch materials are polymeric materials, preferably polymers which are formed into a film or sheet. The pouch material can, for example, be obtained by casting, blow-moulding, extrusion or blown extrusion of the polymeric material, as known in the art. Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Naturally, different film material and/or films of different thickness may be employed in making the compartments of the present invention. A benefit in selecting different films is that the resulting compartments may exhibit different solubility or release characteristics.

Most preferred pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The pouch material herein can also comprise one or more additive ingredients. For example, it can be beneficial to add plasticisers, for example glycerol, ethylene glycol, diethyleneglycol, propylene glycol, sorbitol and mixtures thereof. Other additives include functional detergent additives to be delivered to the wash water, for example organic polymeric dispersants, etc.

For reasons of deformability pouches or pouch compartments containing a component which is liquid will preferably contain an air bubble having a volume of up to about 50%, preferably up to about 40%, more preferably up to about 30%, more preferably up to about 20%, more preferably up to about 10% of the volume space of said compartment.

The pouches may be of any size or shape, comprising at least one compartment. However the pouches may comprises 2 or 3 or more compartment. Where the pouch comprises a second and optionally third compartment, it is preferred that the second and optionally third compartments are superimposed on the first compartment.

The pouches described herein may be made using any known technique, but are preferably vacuum, thermoformed using the horizontal form film technique.

Examples

The present examples are representative of the present invention and not intended to be limiting. Table 4 represents liquid detergent compositions according to the invention. Compositions A to E can either be enveloped in a water-soluble film or packaged in a bottle. Product E is a pouched composition, with 3 separate compartments, with different compositions.

| | A | B | C | D | E | F 3 compartments pouched product | | |
|---|---|---|---|---|---|---|---|---|
| Form | liquid | liquid | liquid | liquid | gel | liq | liq | liq |
| Compartment # | 1 | | | | | 1 | 2 | 3 |
| **Dosage (g)** | **36.0** | **38.0** | **32.0** | **36.0** | **40.0** | **34.0** | **3.5** | **3.5** |
| Alkylbenzene sulfonic acid | 14.5 | 13.8 | 16.0 | 14.5 | 13.5 | 14.5 | 20.0 | |
| Alkyl sulfate | | | | | | | | |
| $C_{12-14}$ alkyl ethoxy 3 sulfate | 8.5 | 16.4 | 10.0 | 8.5 | 15.0 | 8.5 | | |
| $C_{12-13}$ alkyl 3-ethoxylate | | | | 13.0 | | | | |
| $C_{12-14}$ alkyl 7-ethoxylate | 12.5 | 9.0 | 14.0 | | 4.0 | 12.5 | 17.0 | |
| Dimethyl Hydroxyethyl Lauryl Ammonium Chloride | | | | | | | | |
| Zeolite A | | | | | | | | |
| C12-18 Fatty acid | 14.5 | 8.5 | 16.0 | 15.0 | 7.2 | 14.5 | 13.0 | |
| Citric acid | | | | 2.0 | 4.1 | | | |
| Sodium acetate | | | | | | | | |
| enzymes | 0-3 | 0-3 | 0-3 | | 0-3 | 0-3 | 0-3 | |
| Sodium Percarbonate | | | | | | | | |
| TAED | | | | | | | | |
| Organic catalyst[1] | | | | | | | | |
| PAP granule[2] | | | | | | | | 50.0 |
| Acrylic acid/Maleic acid copolymer | | | | | | | | |

-continued

| | A | B | C | D | E | F 3 compartments pouched product |
|---|---|---|---|---|---|---|
| Ethoxysulfated Hexamethylene Diamine Dimethyl Quat | | 3.0 | | | | 2.2 |
| Ethoxylated Polyethylenimine[3] | 4.0 | 1.0 | | 4.0 | 3.0 | 2.0 |
| Hydroxyethane diphosphonic acid | 1.0 | 1.0 | | | 1.6 | 0.6 | 0.6 |
| Ethylene diamine tetra(methylene phosphonic) acid | | | | 1.0 | | |
| Brightener | 0.2 | 0.2 | 0.3 | 0.3 | 0.2 | 0.2 | 0.2 |
| Polydimethyl Siloxane | | | 3.0 | | | |
| Hueing dye[4] | | | | | | 0.05 |
| Perfume | 1.8 | 1.7 | 1.9 | 1.8 | 1.7 | 1.7 |
| Water and minors | | | | To 100% | | |
| Buffers (sodium carbonate, monoethanolamine)[5] | | | | To pH 8.0 | | |
| Solvents (1,2 propanediol, ethanol), Sulfate | | | | | To | |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A surfactant concentrate comprising at least about 75% of an essentially completely neutralized anionic sulphated surfactant, about 5% to about 25% carboxylic acid, of which about 4% to about 96% of the carboxylic acid is in its free acid form, wherein said anionic sulphated surfactant comprises an alkyl alkoxy sulphate, wherein the alkyl group contains from about 10 to about 22 carbon atoms and the alkoxy group contains from about 1 to about 15 alkoxylate moieties and further wherein said concentrate comprises 0% of a nonionic surfactant.

2. The surfactant concentrate according to claim 1, wherein the carboxylic acid comprises a fatty acid having an average of from about 8 to about 28 carbon atoms.

3. The surfactant concentrate according to claim 1, wherein about 60% to about 90% of the carboxylic acid is present in its free acid form.

4. The surfactant concentrate according to claim 1, wherein the concentrate additionally comprises from about 0 to about 10% water.

5. The surfactant concentrate according to claim 1, wherein the concentrate has pH in the range of from about 5 to about 7.5.

6. A process of preparing the concentrate according to claim 1 comprising:

a. combining an anionic sulphated surfactant acid precursor with a sufficient amount of a neutralizing agent to essentially completely neutralize said anionic surfactant, and about 5% to about 25% by weight of the concentrate of a carboxylic acid, of which about 4% to about 96% of the carboxylic acid is in its free acid form.

7. A detergent product composition comprising the surfactant concentrate according to claim 1, and less than about 20% water.

8. A detergent product composition enveloped in a film having a Water-Solubility of at least 50%, said detergent composition comprising a surfactant concentrate comprising at least about 75% of an essentially completely neutralized anionic sulphated surfactant, about 5% to about 25% carboxylic acid, of which about 4% to about 96% of the carboxylic acid is in its free acid form.

9. The detergent product composition according to claim 8, wherein said anionic sulphated surfactant comprises an alkyl alkoxy sulphate, wherein the alkyl group contains from about 10 to about 22 carbon atoms and the alkoxy group contains from about 1 to about 15 alkoxylate moieties.

10. The detergent product composition of claim 9, said concentrate comprising no more than 10 wt % water by weight of the concentrate.

* * * * *